United States Patent [19]

Lyons

[11] Patent Number: 4,582,497

[45] Date of Patent: Apr. 15, 1986

[54] DECORATIVE SPINNER

[76] Inventor: William J. Lyons, 9650 Mark Rd., Erie, Pa. 16509

[21] Appl. No.: 630,362

[22] Filed: Jul. 12, 1984

[51] Int. Cl.[4] ..... A63H 33/40; A63H 23/08

[52] U.S. Cl. ..... 446/217; 446/266; D21/93

[58] Field of Search ..... 446/217, 218, 236, 237, 446/238, 241, 248, 250, 255, 266, 488, 487, 38, 57, 58, 59; D21/22, 85, 86, 90, 91, 92, 93, 119

[56] References Cited

U.S. PATENT DOCUMENTS

| | | | |
|---|---|---|---|
| D. 183,356 | 8/1958 | Lewis | D21/93 |
| D. 221,453 | 8/1971 | Swanberg | D21/93 X |
| D. 268,053 | 2/1983 | Kozlowski | D21/93 X |
| 770,327 | 9/1904 | Smith | 446/217 |
| 1,459,475 | 6/1923 | Marheine | 446/237 |
| 1,550,413 | 8/1925 | Ananian | 446/217 |
| 1,714,419 | 5/1929 | Dick | 446/217 |
| 2,108,002 | 2/1938 | Smith et al. | 446/218 X |
| 2,857,507 | 10/1958 | Stec | 446/217 X |
| 2,996,120 | 8/1961 | McGregor | 446/217 X |

*Primary Examiner*—Robert A. Hafer
*Assistant Examiner*—D. Neal Muir
*Attorney, Agent, or Firm*—Ralph Hammar

[57] ABSTRACT

A decorative spinner in which a hub and wind actuated blades are molded in one piece of plastic. The blades are connected to the hub by triangular spokes substantially in planes including the axis of the hub. Each spoke connects the leading and trailing edges of adjacent blades.

8 Claims, 4 Drawing Figures

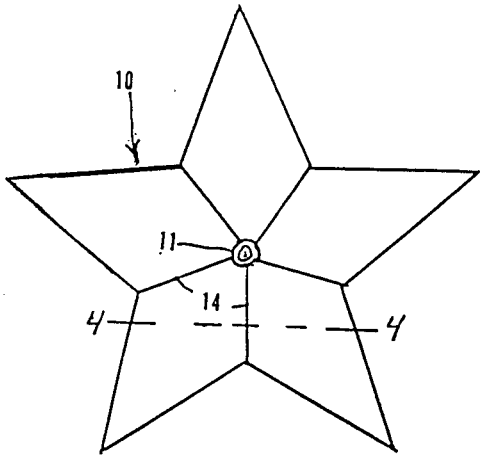
FIG. 3
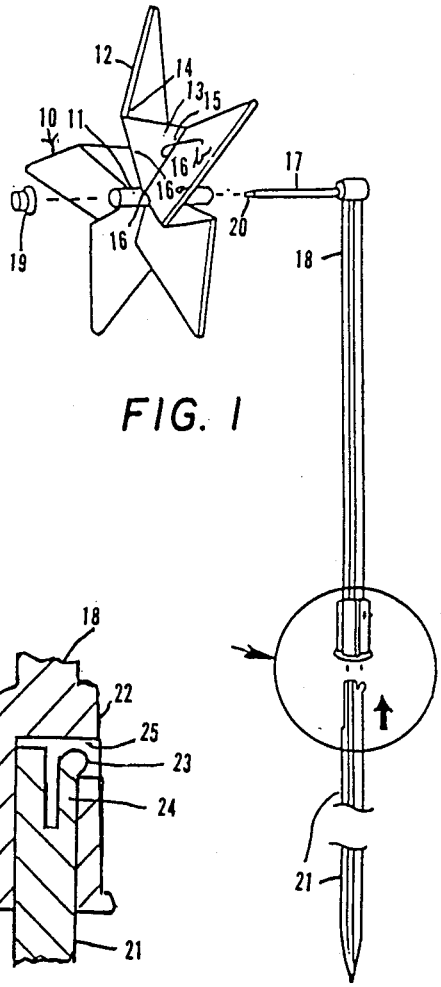
FIG. 1
FIG. 2
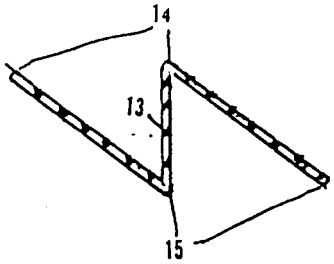
FIG. 4

DECORATIVE SPINNER

This invention is a decorative wind actuated spinner adapted for molding from plastic. The spinner element is molded in one piece of plastic with a hub having radially extending triangular spokes substantially in the plane of the axis of the hub. Each spoke connects the leading and trailing edges of adjacent blades.

In the drawing, FIG. 1 is an exploded view of the spinner, FIG. 2 is a fragmentary section through the joint between the stem sections, FIG. 3 is a front view of the spinner, and FIG. 4 is a section on line 4—4 of FIG. 3.

Referring to the drawing, the spinner 10 has a hub 11 with radially extending blades 12 inclined at the desired pitch angle and connected to the hub by triangular spokes 13 each extending between the leading edge 14 and the trailing edge 15 of adjacent blades. As is apparent from FIG. 4, the spokes 13 are substantially in a plane which includes the axis of the hub 11. Each spoke 13 is of generally triangular shape with its apex 16 united to the hub and with the adjoining side edges 16*a* and 16*b* of the triangle diverging outward and united with the leading and trailing edges of adjacent blades.

The spinner is symmetrical in the sense that the blades have the same pitch angle whether viewed from the front or the back. This means that the spinner operates with equal efficiency whether the wind is blowing on the front face of the spinner or on the back face of the spinner. This is ideal for decorative spinners which should be rotated by a breeze from any direction. It is essential that the tips of the blades project radially outward beyond the spokes as shown in FIGS. 1 and 3. With this projection, the spinner turns into the wind and rotates as described. Lacking this projection, the blades do not turn into the wind and do not spin.

The hub 11 is journaled on a stub shaft 17 integral with the upper end of stem section 18. The spinner hub is held on the shaft by a cap 19 having a snap connection 20 to the outer end of the stub shaft. The lower stem section 21 has a telescoping fit in a socket 22 at the lower end of the upper stem section 18. A snap connection between the stem sections is made by a ball detent 23 at the upper end of a spring member 24 integrally molded with the upper end of the lower stem section 21. The ball 23 fits into a hole 25 in the socket section 22 of the stem section 18. This provides a snap connection which holds the two stem sections together when assembled, but which allows the stem sections to be disassembled and reassembled easily.

The unit may be installed by driving the stem section 21 into the ground far enough to provide a stable support. The unit is weatherproof, is not affected by rain, snow or ice, and does not have to be brought inside for the winter.

I claim:

1. A spinner or impeller comprising a hub, a plurality of blades inclined at a pitch angle to the axis of the hub, each blade having a leading edge and a trailing edge, a plurality of spokes each fastened to the hub and extending therefrom in a plane including the length of the hub, each spoke between and united to the leading edge of one blade, along a linear dimension thereof, and the trailing edge of the adjacent blade, along a linear dimension thereof and the blades having tips projecting radially outward beyond the spokes.

2. The structure of claim 1 in which the spokes are triangular with an apex united to the hub and with sides adjoining said apex respectively joined to said leading and said trailing edge.

3. The structure of claim 1 in which the spokes are in planes including the axis of the hub.

4. The structure of claim 1 in which the spinner is symmetrical about a plane perpendicular to the axis of the hub.

5. The structure of claim 1 in which said hub is journaled on a stub shaft projecting laterally from a stake having its lower end adapted to be driven into the ground.

6. The structure of claim 2 in which said hub is journaled on a stub shaft projecting laterally from a stake having its lower end adapted to be driven into the ground.

7. The structure of claim 3 in which said hub is journaled on a stub shaft projecting laterally from a stake having its lower end adapted to be driven into the ground.

8. The structure of claim 4 in which said hub is journaled on a stub shaft projecting laterally from a stake having its lower end adapted to be driven into the ground.

* * * * *